US005997406A

United States Patent [19]

Selton

[11] Patent Number: 5,997,406

[45] Date of Patent: Dec. 7, 1999

[54] BALL RECEIVER

[76] Inventor: Daniel E. Selton, 5350 Powers Ferry Rd., Atlanta, Ga. 30327

[21] Appl. No.: 09/019,238

[22] Filed: Feb. 5, 1998

[51] Int. Cl.[6] ..... A63B 69/36

[52] U.S. Cl. ..... 473/180; 473/186

[58] Field of Search ..... 473/180–189, 473/172–174

[56] References Cited

U.S. PATENT DOCUMENTS

| | | | |
|---|---|---|---|
| D. 174,253 | 3/1955 | Evans | D34/5 |
| 1,101,203 | 6/1914 | Lueder | 473/189 |
| 1,229,766 | 6/1917 | Long | 473/187 |
| 1,287,903 | 12/1918 | Daily | 473/180 |
| 2,475,763 | 7/1949 | Vandal | 473/186 |
| 2,933,318 | 4/1960 | Boynton | 473/186 |
| 3,070,372 | 12/1962 | Brinati et al. | 473/180 |
| 3,909,007 | 9/1975 | Wuertemburg et al. | 473/188 |
| 4,647,047 | 3/1987 | Little | 473/187 |
| 4,878,671 | 11/1989 | Gubany | 273/176 R |
| 4,925,191 | 5/1990 | Ogilvie | 473/189 |
| 5,257,808 | 11/1993 | Mueller et al. | 273/178 R |
| 5,487,545 | 1/1996 | Schindler | 273/178 R |

*Primary Examiner*—Mark S. Graham
*Attorney, Agent, or Firm*—Troutman Sanders LLP; Gerald R. Boss, Esq.

[57] ABSTRACT

A ball receiver for being positioned on a generally horizontal surface for receiving a moving ball. The ball includes an outer wall of a general height which is sloped which is interconnected with a ball receptacle for receiving a moving ball. A force absorbing member extends vertically from the central receptacle base to a height at least equal to the outer wall for absorbing the force of a moving ball.

15 Claims, 3 Drawing Sheets

BALL RECEIVER

This invention relates generally to a ball receiver and more particularly to a putting training apparatus which consists of a golf ball receiver cup which may be positioned on flat horizontal surfaces for receiving a golf ball wherein the golf ball receiver cup includes a force absorption member.

Many people enjoy the game of golf and indeed practice their golf swing. One particular swing practiced is the putting stroke which entails hitting a golf ball with a putter over a horizontal surface into a cup. The uniqueness of practicing putting, is that it may be practiced over any general horizontal surface such as a floor, or lawn. Accordingly, the only requirement is that a receptacle exist for receiving the ball. Since it is impractical to cut holes into the lawn and into floors, many portable putting training devices have been created which include a central receptacle enclosed within a sloped peripheral wall for receiving a golf ball.

A common problem with portable putting cups is that they do not correctly simulate actual putting conditions. For instance, golf holes extend into the earth and accordingly have a lip which is generally horizontal. However, in order to create a golf ball receptacle on a flat surface, the walls surrounding the receptacle must be sloped upward to define a cavity. This construction requires more force to be exerted onto the golf ball in order for the golf ball to enter the golf ball receptacle than would actually be required on an actual putting green. Many such designs have been created for portable golf putting cups.

For instance, U.S. Pat. No. 5,487,545 discloses a portable golf putting cup which includes a circular base and having upwardly curved outer walls that graduate the golf ball into a circular central depression. The putting cup includes an angled shock absorbing lip and golf ball gripping teeth in addition to shock absorbing material at the bottom of a cavity. However, the shock absorbing material is horizontally located in the base of the cavity which may inadvertently bounce a ball out of the cavity.

Design Pat. No. Des. 273,126 discloses a horseshoe-shaped cup. While this cup is suitable for its intended purpose, should the ball not find the target of the cup, the ball is out of play and the ball or cup must be repositioned since the horseshoe cup only has one target line which will enable the ball to roll into the cup.

Another disadvantage with such designs is that if one hits the ball with enough pace to decisively sink the putt, the golf ball may kick out of the cup because the vertical inner walls are not of sufficient height to hold the ball. To counteract this dilemma, vertical inner walls have been proposed which are high enough to hold the ball but result in either making the cup larger than realistically possible, or including inner walls which are so high that the amount of energy required to hit the ball over the graduated wall is not replicative of actual putting conditions which have a non-angled positional area which leads into a cup.

Accordingly, there is a need for an improved portable golf ball receiver that is approachable from a 360° angle and which will effectively reproduce an accurate representation of a regulation putting cup;

Accordingly, it is an object of the present invention, to provide a portable golf ball receiving cup that is approachable from a 360° angle and which will effectively reproduce an accurate representation of a regulation putting cup by minimizing the angle of an outer wall which defines the receiving cavity;

Furthermore, it is an object of the present invention to provide a portable golf ball receiving cup which includes a force absorbing member which is located within the receiving cup for decelerating a golf ball.

SUMMARY OF THE INVENTION

The above objectives are accomplished according to the present invention by providing a ball receiver for being positioned on a generally horizontal surface for receiving a moving ball. The ball receiver includes an outer wall of a general height which is sloped and which is interconnected with a ball receptacle for receiving a moving ball. A force absorbing member extends vertically from the interior of the ball receptacle to a height at least equal to the outer wall for absorbing the force of a moving ball.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERED EMBODIMENT

Figure 1:
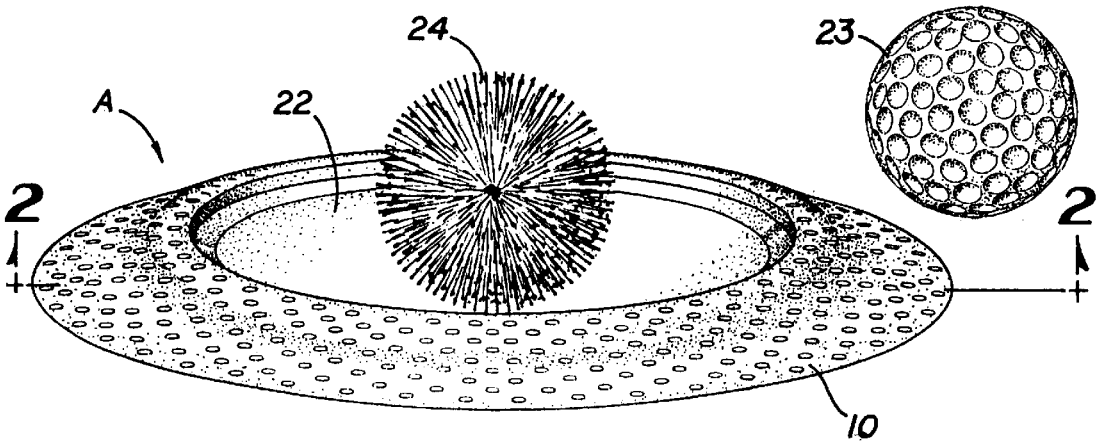
FIG. 1 is a perspective view of a golf ball receiver according to the present invention.

As shown in FIG. 1, golf ball receiver A receives a golf ball for the purpose of practicing putting. Golf ball receiver A is intended to be positioned on a generally horizontal, flat surface for presenting a target hole. Golf ball receiver A includes annular outer wall 10 and ball receptacle 22 which is a cavity for receiving a golf ball. In the preferred embodiment, internal cup wall 14 in combination with central receptacle base 12 defines ball receptacle 22 for receiving golf ball 23. Of course, ball receptacle 22 may include other configurations which define a cavity sufficient to receive a golf ball. Force absorbing member 24 is disposed within ball receptacle 22 for absorbing the force of golf ball 23 when the golf ball enters ball receptacle 22. Preferably, force absorbing member 24 is centrally located within ball receptacle 22. Annular outer wall 10 and ball receptacle 22 are both annular enabling a golf ball to be targeted to ball receptacle 22 at a three hundred and sixty degree angle around golf ball receiver A.

Figure 2:
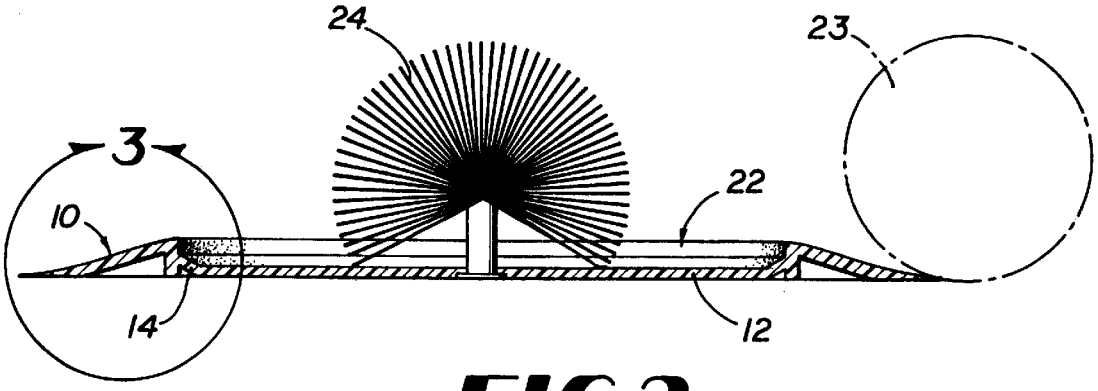
FIG. 2 is a sectional view taken along line 2—2 of FIG. 1 of a golf ball receiver according to the present invention illustrating a force absorbing member in a first undeformed position for receiving a golf ball according to the present invention.

As shown in FIG. 2, annular outer wall 10 includes base portion 26, top surface 28 and side wall 30 which abuts internal cup wall 14. Annular outer wall 10 is preferably dimpled to reduce loss of kinetic energy when golf ball 23 engages annular outer wall 10. Annular outer wall 10 is sloped including lower outer wall portion 32 and upper outer wall portion 34 having transitional area 36. In the preferred embodiment, lower outer wall portion 32 is concave and upper outer wall portion 34 is convex defining transitional area 18 where the angle of curvature is reversed such that upper outer wall portion 32 is generally horizontal at a point where top surface 28 abuts side wall 30. This configuration enables the forces of golf ball 23 to be generally horizontal as they would typically be on an actual putting surface prior to entering ball receptacle 22. Accordingly, while a sloped outer wall is necessary in order to create a cavity for receiving a golf ball, by incorporating a transitional area where the slope of the wall changes from vertical to horizontal, actual putting conditions may be duplicated.

Figure 7:
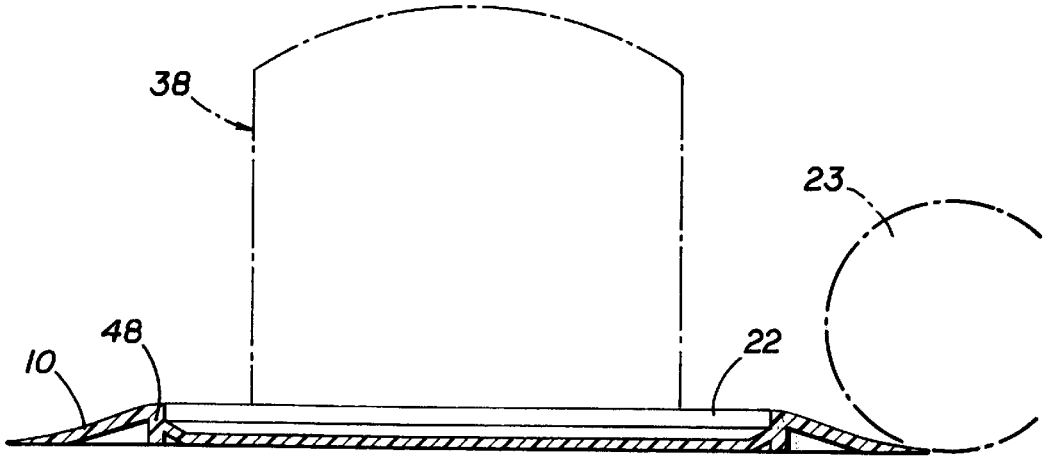
FIG. 7 is a sectional view illustrating a force absorbing zone for absorbing the force of a golf ball within a receiver cup according to the present invention.

As shown in FIGS. 1, 2, 4 and 5, force absorbing member 24 is disposed within ball receptacle 22 for absorbing the force of golf ball 23 when it enters in ball receptacle 22. In actual putting conditions, the depth of a golf cup will overcome the general horizontal forces of a golf ball if the golf ball is not struck too hard. However, since the height of annular outer wall 10 is preferably only a quarter of an inch, the depth of ball receptacle 22 is minimal and due to central receptacle base 12 being positioned on a horizontal floor, golf ball 23 would typically pass through ball receptacle 22 to the other side of annular outer wall 10 and exit the periphery of golf ball receiver A. Accordingly, force absorbing member 24 absorbs the horizontal forces of golf ball 23 to maintain golf ball 23 within ball receptacle 22 if golf ball 23 is not struck to hard. In the preferred embodiment, force absorbing member 24 is resilient and has a first non-deformed position and deforms upon impact by golf ball 23 such that force absorbing member 24 has a second deformed position wherein at least a portion of the force of golf ball 23 has been absorbed. As shown in FIG. 7, the profile of force absorbing member 24 defines a force absorbing zone 38 which is vertically above central receptacle base 12 to a height at least to a height above annular outer wall 10 and preferably to a height above a golf ball. In the preferred embodiment, force absorbing member 24 is a KOOSH ball (trademark) manufactured by Oddzon products of Campbell Calif. which include resilient fingers which extend outward from a central area to define force absorption zone 38. Preferably, the resilient fingers extend radially outward from the center of ball receptacle 22 and preferably horizontally terminate at least prior to reaching side wall 30 defining force absorption zone 38.

Figure 3:
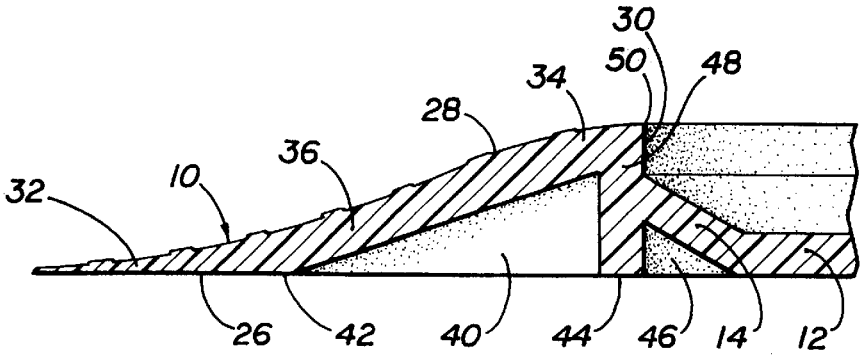
FIG. 3 is a blown up view of an annular outer wall of a golf ball receiver according to the present invention.
Figure 4:
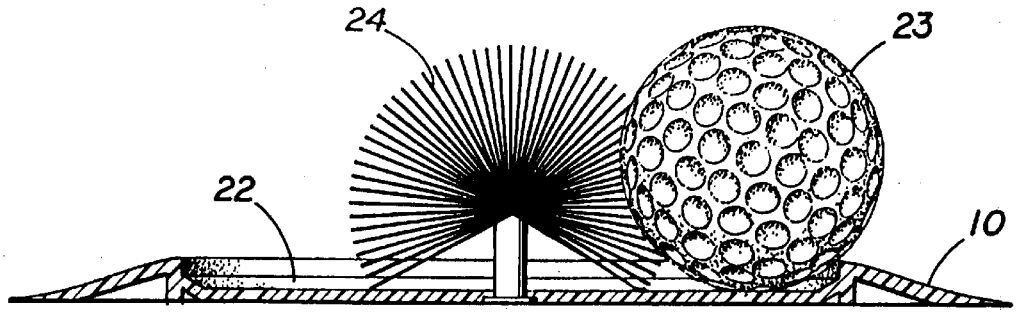
FIG. 4 is a sectional view illustrating a force absorbing member in a second deformed position absorbing the force of a golf ball according to the present invention.
Figure 5:
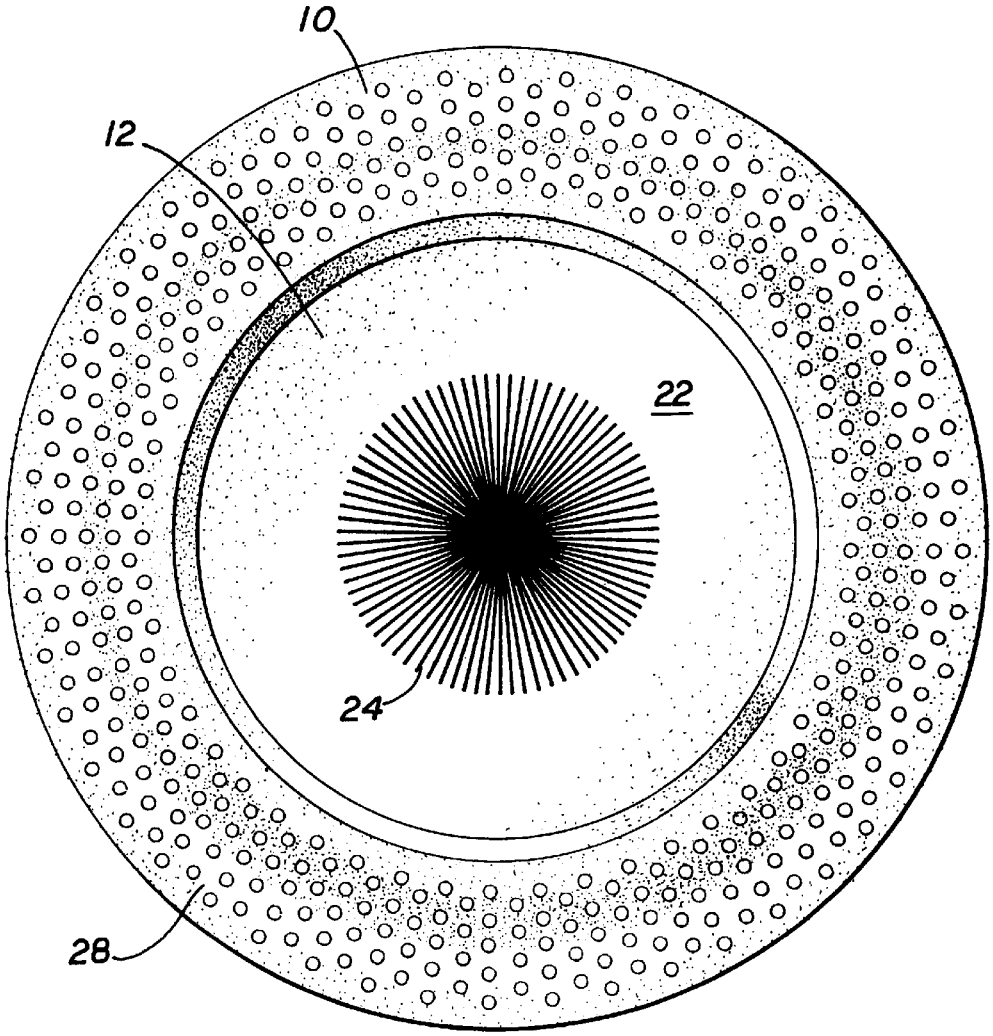
FIG. 5 is a top perspective view of a golf ball receiver according to the present invention.
Figure 6:
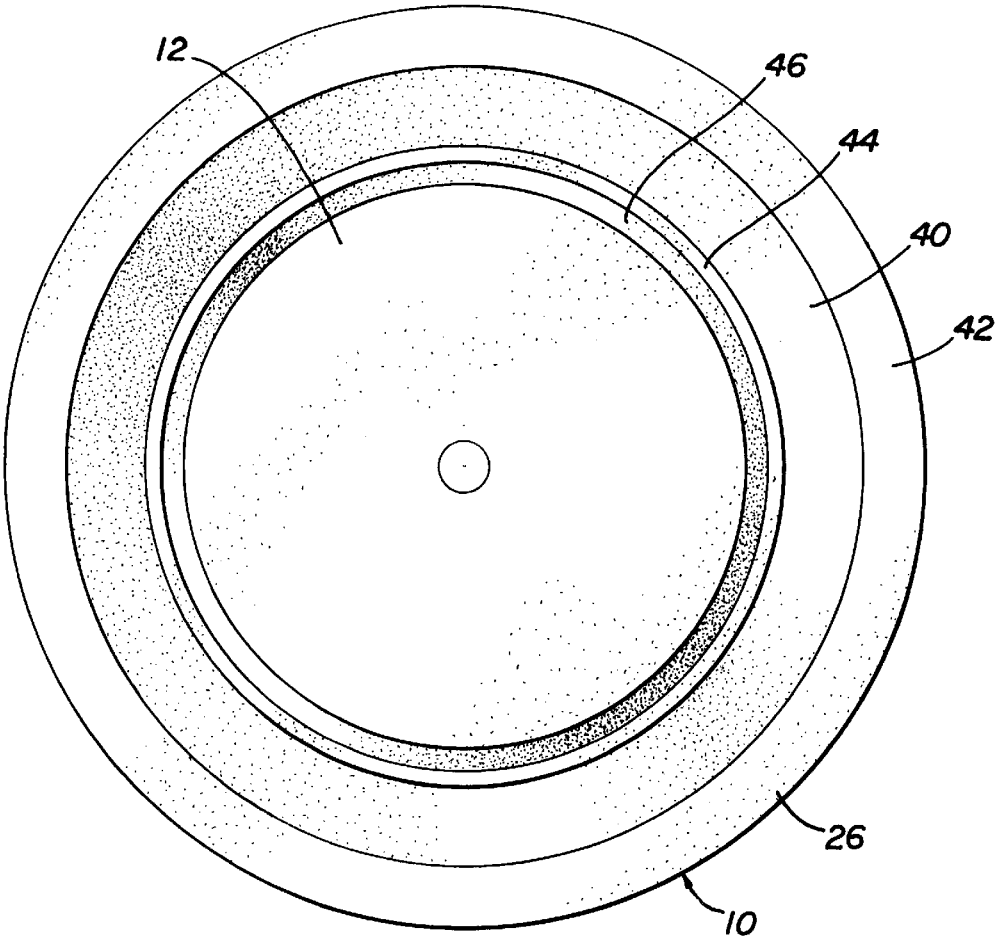
FIG. 6 is a bottom perspective view of a golf ball receiver according to the present invention.

Furthermore, as further shown in FIGS. 2, 3 and 6, first air channel 40 is defined within the bottom of golf ball receiver A enabling annular outer wall 10 to deflect downward to overcome gravitational forces exhibited on golf ball 23 as golf ball 23 climbs upward over annular outer wall 10 prior to entering ball receptacle 22. This configuration simulates actual putting conditions. In the preferred embodiment, golf ball receiver A is made from soft rubber or plastic. Accordingly, by positioning an air channel beneath the sloping portion of annular outer wall 10, annular outer wall 10 may deflect downward into first air channel 40 under the weight of the golf ball to absorb forces exhibited by gravity. Base portion 26 includes first base portion 42 and second base portion 44 which are offset to define first air channel 40. First and second base portions 42 and 44 may be offset at any location whereby first air channel 40 is defined underneath annular outer wall 10 between annular outer wall 10 and the horizontal surface which golf receiver A is positioned upon. In the preferred embodiment, second base portion 44 is vertically aligned with top of annular outer wall 48 so that the weight of golf ball 23 as it rolls over top of annular outer wall 48 may depress second base portion 42 into a carpeted surface. Annular outer wall 10 is also offset from central receptacle base 12 to define second air channel 46 underneath internal cup wall 14 for enabling second base portion 42 to be depressed into a carpeted surface as a golf ball rolls over top of annular outer wall 48.

As shown in FIG. 3, interior cup wall 14 may connect with annular outer wall 10 at side wall 30 at a distance beneath the top of annular outer wall 48 to define lip 50. The preferred length or curvature of interior cup wall 14 is smaller than the radius of a golf ball such that a first portion of a golf ball will engage lip 50 and a second portion of a golf ball will simultaneously engage central receptacle base 12 without engaging interior cup wall 14 to encourage a golf ball to be maintained within ball receptacle 22. In the preferred embodiment, interior cup wall 14 is also annular. Central receptacle base 12 may engage annular outer wall 12 directly without an intermediary internal cup wall.

In operation, a golf ball is putted along a target line to the center of golf ball receiver A. The golf ball rises up concave lower outer wall portion 32 of outer wall 10 and subsequently rolls along a generally horizontal plane as defined by convex upper outer wall portion 32. Outer wall 10 deflects downward into first air channel 40 to absorb gravitational forces on the golf ball. Golf ball 23 subsequently enters into force absorbing zone 38 and engages deformable force absorbing member 24. Force absorbing member 24 initially receives golf ball 23 and absorbs energy from the golf ball. If the golf ball has not been stricken too hard, force absorbing member 24 absorbs a sufficient amount of energy to retain golf ball 23 within ball receptacle 22. However if the golf ball has been hit too hard, force absorbing member 24 will not absorb a sufficient amount of energy to retain golf ball 23 within ball receptacle 22 and golf ball 23 will skirt out of ball receptacle 22. Also, golf ball receiver A may slide from the force of golf ball 23 engaging internal cup wall 14 thereby absorbing some of the golf ball's energy and maintaining golf ball 23 within ball receptacle 22.

In the preferred embodiment, annular outer wall 10 is a quarter of an inch in height and lower outer wall portion 32 has a first concave slope of a radius greater than the radius of a golf ball. The concave slope assists in minimizing any loss of kinetic energy which may occur when golf ball 23 engages annular outer wall 12. A typical golf ball is one and five eighth's inches in diameter and ball receptacle 22 is two and three eighth's inches in diameter with energy absorbing member 24 defining an energy absorbing area which invades a portion of an area above central receptacle base 12. Also, since golf ball 23 is significantly higher than the top of annular outer wall 10, energy absorbing member 24 preferably extends at least vertically to a height of one and five eighth's inches which is equal to the height of the golf ball.

Accordingly, a more advantageous design for a putting practice device may be had according to the present invention by providing a golf ball receiver cup which has a generally sloped outer wall which terminates into a golf ball receiving area at a generally horizontal plane for replicating actual putting conditions. An energy absorbing member is located within the golf ball receiving area for absorbing energy from the golf ball and retaining the golf ball within the golf ball receiving area if the golf ball is not hit harder than that which would make a golf ball rim out of a cup under actual putting conditions. Also, the low height of the sloped outer wall also enables golf balls hit with low energy to enter into the golf ball receiving area.

What is claimed is:

1. A ball receiver for being positioned on a generally horizontal surface for receiving a moving ball comprising:

a circular outer wall of a general height which is sloped defining a three hundred and sixty degree perimeter, said circular outer wall defining an interior;

a ball receptacle defined within the interior of said outer wall for receiving a moving ball which is accessible from any angle within a three hundred and sixty degree angle of approach;

a force absorbing member extending vertically within said ball receptacle to a height at least equal to said outer wall for absorbing the force of a moving ball;

said force absorbing member being deformable from any angle within a three hundred and sixty degree angle of approach;

said force absorbing member having a first undeformed position prior to engaging a moving ball and a second deformed position when engaging a moving ball within a force absorbing zone for absorbing the force of a moving ball; and said force absorbing member being offset from said circular outer wall enabling a golf ball to enter said ball receptacle prior to engaging said force absorbing member.

2. The ball receiver of claim 1 wherein said force absorbing member is resilient having a first undeformed position prior to engaging a moving ball and a second deformed position when engaging a moving ball for absorbing the force of a moving ball.

3. The ball receiver of claim 1 wherein said force absorbing member includes resilient fingers extending outward from a central area for engaging a moving ball for absorbing the force of a moving ball.

4. The ball receiver of claim 1 wherein said force absorbing member has a general profile defining a force absorbing area which extends above the height of said outer wall for absorbing the force of a moving ball.

5. The ball receiver of claim 1 wherein said outer wall includes a lower outer wall portion which is concave and an upper outer wall portion which is convex transitioning to a generally horizontal surface at the top of said outer wall.

6. The ball receiver of claim 1 wherein said force absorbing member is disposed within the center of said ball receptacle.

7. The ball receiver of claim 1 wherein said outer wall includes a first base portion and a second base portion for resting on a horizontal surface, said first base portion being offset from said second base portion defining a first air channel disposed underneath a top surface of said outer wall.

8. The ball receiver of claim 1 wherein the height of said outer wall is not greater than a quarter of an inch.

9. The ball receiver of claim 1 wherein said outer wall has a dimpled surface contour.

10. A ball receiver for being positioned on a generally horizontal surface for receiving a moving ball comprising:

an outer wall of a general height which is sloped;

an inner cup wall connected to said outer wall defining a ball receptacle;

a force absorbing member support integral with said inner cup wall;

a force absorbing member extending vertically from said force absorbing member support to a height above the height of a ball for absorbing the force of a moving ball and extending horizontally within said receiver cup to a position which is offset from said outer wall enabling a moving ball to enter said receiver cup thereby defining a force absorbing zone;

said force absorbing member being resilient having a first undeformed position prior to engaging a moving ball and a second deformed position when engaging a moving ball for absorbing the force of a moving ball wherein said force absorbing member being higher than said ball will provide a downward force onto said ball thereby assisting in maintaining the ball within the ball receptacle when absorbing the force of the moving ball.

11. The ball receiver of claim 10 wherein said force absorbing member includes resilient fingers extending outward from a central area for engaging a moving ball for absorbing the force of a moving ball.

12. The ball receiver of claim 10 wherein said outer wall includes a lower outer wall portion which is concave and an upper outer wall portion which is convex transitioning to a generally horizontal surface at the top of said outer wall.

13. The ball receiver of claim 10 wherein said outer wall includes a first base portion and a second base portion for resting on a horizontal surface, said first base portion being offset from said second base portion defining a first air channel disposed underneath a top surface of said outer wall.

14. The ball receiver of claim 10 wherein a side of said outer wall is offset from said central receptacle base defining a second air channel disposed underneath said internal cup wall.

15. The ball receiver of claim 10 wherein said outer wall includes a top portion, said inner cup wall being vertically off set from said top portion of said outer wall defining a lip, said inner cup wall being of limited length wherein a golf ball abutting said lip and said central receptacle base will not engage said inner wall.

* * * * *